US010206479B2

(12) United States Patent
Gieux et al.

(10) Patent No.: US 10,206,479 B2
(45) Date of Patent: Feb. 19, 2019

(54) APPLICATION HEAD FOR A PRODUCT, IN PARTICULAR SKIN CARE, COMPRISING AN APPLICATOR BALL HELD BY A MAGNET

(71) Applicant: COSMOGEN SAS, Paris (FR)

(72) Inventors: Gérard Gieux, Brussels (BE); Philippe Bonneyrat, Herblay (FR)

(73) Assignee: COSMOGEN SAS, Paris (FR)

( * ) Notice: Subject to any disclaimer, the term of this patent is extended or adjusted under 35 U.S.C. 154(b) by 179 days.

(21) Appl. No.: 15/293,341

(22) Filed: Oct. 14, 2016

(65) Prior Publication Data

US 2017/0027302 A1 Feb. 2, 2017

Related U.S. Application Data

(63) Continuation of application No. PCT/FR2015/051000, filed on Apr. 14, 2015.

(30) Foreign Application Priority Data

Apr. 14, 2014 (FR) ..... 14 53320

(51) Int. Cl.
*A61H 15/00* (2006.01)
*A45D 34/04* (2006.01)
*A45D 40/26* (2006.01)

(52) U.S. Cl.
CPC ..... *A45D 34/041* (2013.01); *A45D 40/261* (2013.01); *A61H 15/00* (2013.01);
(Continued)

(58) Field of Classification Search
CPC ..... A45D 40/26; A45D 40/261; A45D 34/04; A45D 34/041; A45D 2200/20;
(Continued)

(56) References Cited

U.S. PATENT DOCUMENTS 2,486,869 A * 11/1949 Nicholas ..... B43K 1/08 401/211
2,646,776 A 7/1953 Scholz
(Continued)

FOREIGN PATENT DOCUMENTS

FR 947148 6/1949
WO 2011067500 6/2011

OTHER PUBLICATIONS

International Search Report for International Application PCT/FR2015/051000, dated May 29, 2015.

*Primary Examiner* — David Walczak
(74) *Attorney, Agent, or Firm* — Burris Law, PLLC

(57) ABSTRACT

An application head for a product includes a body that is substantially of revolution and has at its front axial end a hollow spherical surface forming a housing that receives a magnetizable applicator ball with a tight fit, said applicator ball being held by a magnet, this body being intended to hold the product on its inside, wherein the body comprises a chamber located along the passage of the product coming from the inside of this body so as to lead into the housing, this chamber containing a magnetized or non-magnetized valve held on its inside, which can slide through a short axial travel while remaining stuck to the applicator ball, so as to close the passage in the rear position and to open this passage in the front position.

17 Claims, 5 Drawing Sheets

(52) U.S. Cl.
CPC ..... *A61H 15/0092* (2013.01); *A45D 2200/20* (2013.01); *A61H 2015/0064* (2013.01); *A61H 2201/0153* (2013.01); *A61H 2201/105* (2013.01)

(58) Field of Classification Search
CPC ..... A61H 15/00; A61H 15/0092; A61H 2015/0064; A61H 2201/0153; A61H 2201/105; B43K 7/00; B43K 7/005; B43K 7/12
See application file for complete search history.

(56) References Cited

U.S. PATENT DOCUMENTS 3,376,551 A * 4/1968 Armbruster ..... B41J 3/00 178/18.07
2012/0238926 A1* 9/2012 Diezinger ..... A45D 34/041 601/154

* cited by examiner

APPLICATION HEAD FOR A PRODUCT, IN PARTICULAR SKIN CARE, COMPRISING AN APPLICATOR BALL HELD BY A MAGNET

CROSS-REFERENCE TO RELATED APPLICATIONS

This application is a continuation of International Application No. PCT/FR2015/051000, filed on Apr. 14, 2015, which claims the benefit of FR 14/53320, filed on Apr. 14, 2014. The disclosures of the above applications are incorporated herein by reference.

FIELD

The present disclosure concerns an application head of a liquid, semi-liquid or viscous product, in particular for the skin care, as well as an applicator of this product equipped with such an application head.

BACKGROUND

The statements in this section merely provide background information related to the present disclosure and may not constitute prior art.

In order to perform an application of a cosmetic product making skin care of a patient as well as a massage of this skin, a known application head, shown in particular by the document WO-A1-2011067500, includes an elongate body having at its front end a spherical-shaped housing fittingly accommodating a massage ball of the skin.

The spherical housing has an outer diameter slightly lower than that of the ball, so as to leave a large surface of this ball outside the housing, which can come into contact with the skin by rolling thereon.

The application ball is retained at the bottom of its housing by a magnet which is held in the body slightly rearward of this housing, in order to permanently exert an attraction on the ball comprising a material attracted by this magnet.

The care product contained in the body, such as a cream or a gel, can exit through the bores located in the surface of the spherical housing in order to come into contact with the rear portion of the ball, then to spread on the skin during massage thereof by rolling this ball which drives and distributes the product.

In order to facilitate a passage of the care product between the surface of the spherical housing and the ball, this housing includes small inner bosses which keep some spacing between the ball and this surface, allowing an exit of the product through the bores of this surface.

A problem which arises with this type of application head is that the passage allowing the exit of the product is never closed, even by pressing on the ball during massages of the skin, the bosses permanently keeping the spacing which allows this passage. It is therefore possible, during use, to have an involuntary product exit which applies a very significant amount.

Furthermore, the device is still open, the product contained in the reservoir cannot be preserved in good conditions, its volatile components may evaporate, while other components can be oxidized or contaminated by external agents.

The document of the prior art also has alternatively an application head type having small bearing balls held in cavities made in the spherical housing, which can slightly slide axially to pass to the inside this housing by forming inner bosses.

The bearing balls are retained backwards by magnets disposed in the body, which attract them, and which also attract the application ball. Thus, a possible slight axial movement of the application ball, which can, by following the bearing balls, move away from the spherical surface in order to allow a passage of the care product, or tighten over this surface in order to close this passage, is obtained.

However, this type of application head containing bearing balls held by a magnet, is relatively complex to be performed, and includes a high cost. Furthermore, the product coming from the reservoir can seep into the housings of the bearing balls, generating a discomfort to the operation, an oxidation of the metal portions, or a proliferation of bacteria.

SUMMARY

The present disclosure provides an application head of a product, including a body substantially of revolution, having at its front axial end a hollow spherical surface forming a housing for fittingly accommodating a magnetizable application ball held by a magnet, this body being provided to accommodate therein the product, characterized in that the body includes a chamber located on the axial passage of the product coming from inside the body to open into the housing, this chamber containing a valve, magnetized or not, held inside, which can slide along a small axial stroke by remaining adhered to the magnetizable application ball, in order to perform in the rear position, a closing of the passage and in the front position, an opening of this passage.

An advantage of this application head is, that in a simple and economical manner, with, as the only movable member, a central magnet disposed in the chamber performing a small axial stroke, when the application ball is not pressed backwards, there are obtained at the same time, the opening of the passage of the product by the lifting of this ball, which is held in its housing with the traction of the magnet which cannot exit its chamber, and a closing of the passage by pressing the application ball on the skin during the massages, which moves back this ball as well as the magnet. This lifting of the ball is performed by pressing the product, which can be generated by a tightening of the flexible walls of the reservoir by the user.

The application head according to the present disclosure may further include one or more of the following characteristics, which can be combined therebetween.

Advantageously, the chamber includes a substantially cylindrical shape disposed parallel to the axis of the body.

In particular, the chamber may be laterally shifted with respect to the axis of the body.

According to one form, the valve is held forwards in the chamber, by an inner relief of this chamber allowing the passage of the product. The body may thus include a single main part.

According to another form, the valve is held forwards in the chamber by an upper portion of the body which is fastened on a base of this body. The body includes two main parts, but the placing of the magnet is simpler to be performed.

According to a variant, the valve is a magnetized ball.

The magnetized valve can close the passage by bearing, in its rear position, on a bore of a rear wall of the chamber which constitutes the passage of fluid product.

According to another variant, the valve is a cylindrical magnet having an outer shoulder which forms a front stop allowing the passage of the product. The cylindrical magnet allows having a magnet with large volume, generating a significant retaining magnetic force for a small diameter. It is therefore appropriate for the reservoirs and the application heads of reduced size.

The application ball may close the passage by bearing, in its rear position, on a boss of the surface of the housing, which surrounds the passage of the product opening into this housing.

Furthermore, the application head may include a spring which constantly presses the valve forwards. The passage of the product can be better provided. Furthermore, this spring allows using a reservoir with rigid walls, the product contained exiting by capillary effect, or by action of the gravity by spilling the reservoir.

Advantageously, the application head includes a cap comprising therein shapes which hold the application ball pressed into the housing. The passage of the product is thus closed and when the cap is placed.

Advantageously, the application ball includes a stainless steel, or a surface treatment protecting from the oxidation.

Advantageously the application ball is hollow, which reduces its weight.

The magnet may be enclosed in a sealed protective casing.

The chamber may contain a valve, the magnet disposed near this chamber, being fixed. It is possible to have a magnet with large volume, which is not in contact with the product. The valve can be therefore manufactured of plastic material (polypropylene, polyethylene, polyoxymethylene, polyester terephthalate, or the like), of glass, of ceramic (alumina, zirconium, silicon carbide), of non-oxidizable metal, or any other rigid, non-oxidizable and non-magnetic material.

The present disclosure also includes an applicator having a cosmetic product reserve and an application head provided to perform massages of the skin, including any one of the preceding characteristics.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
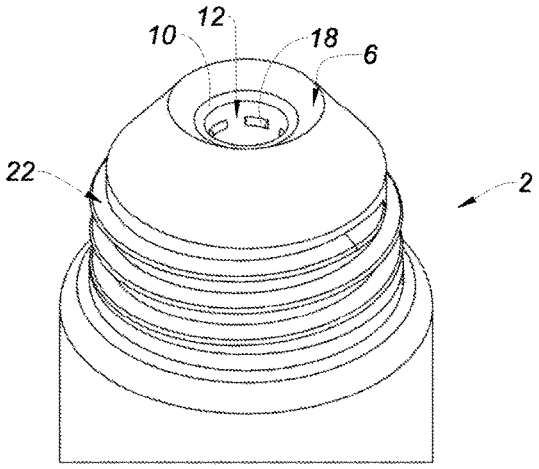
FIG. 1 is a perspective view of an application head according to the invention, shown without the application ball.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
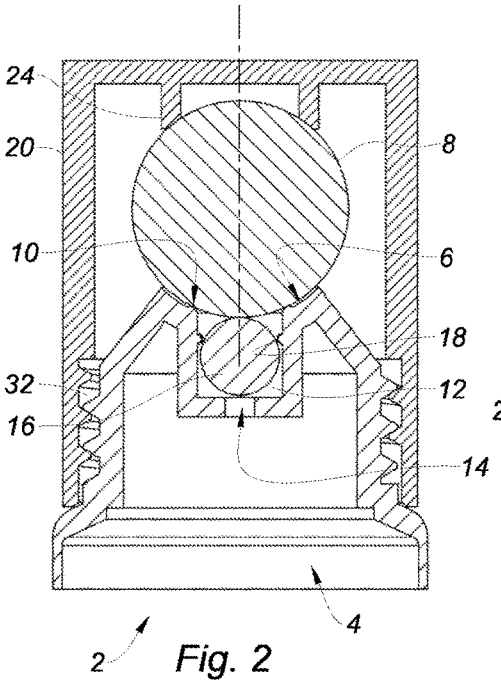
FIGS. 2 and 3 are axial sectional views of this application head, shown successively in the closed position with a plug, and in the open position.
Figure 3:
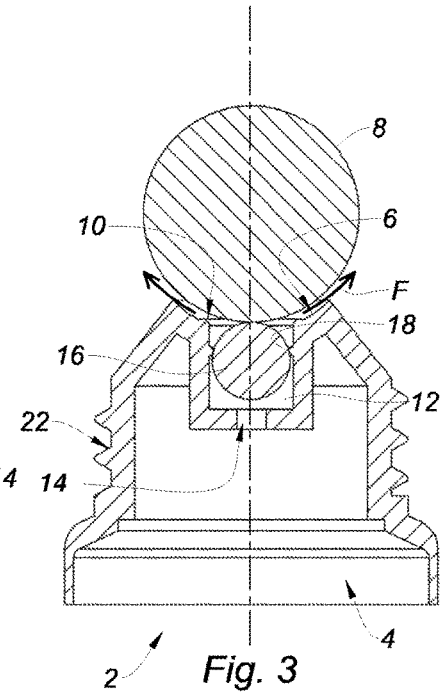

FIGS. 1 to 3 show an application head including a body 2 molded in plastic material, having a symmetry about a vertical axis, having a lower volume 4 containing a care product, supplied by a reserve being located underneath which is not shown. The body of the application head 2 includes the fastening means of the reserve which can be for example a tube, a bottle or a pocket.

The front face of the body 2 includes a housing forming a hollow spherical surface 6, fittingly accommodating an application ball 8 comprising a material attracted by a magnet, such as a steel ball, or a ball made by a molding of a plastic material containing this material.

A cylindrical cap 20 is fitted around the body 2 by inner threads 32, by tightening an outer threading 22 made around this body, ensuring the holding as well as the sealing of this cap. The cap 20 includes, inside, on its front transverse face, a ring 24 centered on the axis which provides the axial wedging of the application ball 8 in order to hold it in its rear position.

The body 2 includes a cylindrical-shaped chamber 12 disposed along the same axis, right rearward of the application ball 8, comprising a rear transverse partition having a central bore 14 allowing the passage of the care product coming from the lower volume 4.

The chamber 12 accommodates a valve formed in this embodiment by a magnetized ball 16, with a radial clearance around this ball allowing the passage of the care product coming from the central bore 14, forwards of the ball.

The magnetized ball 16 is retained forwards by an inner circular relief 18 disposed in the cylindrical wall of the chamber 12, which includes interruptions in order to allow the passage of the care product when the ball is bearing thereon.

The magnetized ball 16 is inserted into the chamber 12 from the front, by forcing on the circular relief 18 in order to cause a slight elastic deformation of the material of the body 12 to move away this relief, which then returns to the position while holding this ball.

During application of the product, the application ball 8 which is in the position shown in FIG. 2, rolls over the skin with some pressure by bearing on a continuous circular boss 10 of the spherical surface of its housing 6, surrounding the cylindrical chamber 12, which closes the passage of the care product coming from this chamber. This boss is optional, the ball can simply bear on the generatrix surrounding the outlet orifice.

The magnetized ball 16 has freely moved back in its chamber 12 without bearing on the rear transverse partition of this chamber, in order to allow pressing the application ball 8 on the continuous circular boss 10.

FIG. 3 shows the application head 2 including the care product pressurized in the lower volume 4, for example when the operator presses on the flexible reservoir containing this product.

There is therefore a passage of the product through the chamber 12, which enters through the bore 14, gets around the magnetized ball 16 which rises while remaining stopped by its inner relief 18, and raises at the same time the application ball 8 which is detached from the circular boss 10 in order to allow the passage of this product outwards following the arrows F, while being held in its housing 6 by the magnetization.

An application head 2, which allows obtaining a closed outlet orifice of the care product when the operator is performing the application, is thus performed in a simple and effective manner, as well as an open orifice when he/she stops this application allowing some outlet of the product coming underneath the application ball 8, which will then be distributed on this ball, then on the surface to be treated in the subsequent applications.

The application head 2 includes few parts, which provides good reliability, as well as an economical realization.

Generally, the application ball 8 may be made of ferritic steel in order to be attracted by a magnet, or of a mixture of ferritic and austenitic steel, in order to take advantages, besides the stainless properties, of the latter.

The ball application 8 may also be protected from the environment by a surface treatment, such as a varnish, a painting or a plastic layer, in order to prevent any chemical reaction with the cosmetic product.

In particular, the application ball 8 made of metal can provide a cooling effect in contact with the skin, thus allowing a decongestion of the sensitive parts of the skin to be treated.

Furthermore, the application ball 8 may be made of metal with an inner cavity, according to a known manufacturing method comprising the assembly by welding of two half-shells. Thus the weight of this ball 8 is limited, which allows the use of a smaller magnet to retain it.

Figure 4:
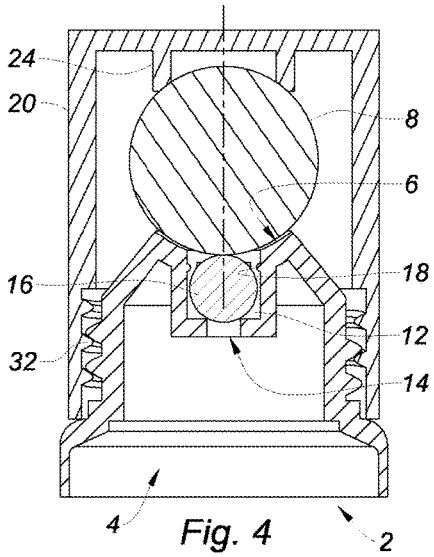
FIGS. 4 and 5 are axial sectional views of an application head according to a variant, shown successively in the closed position with a cap, and in the open position.
Figure 5:
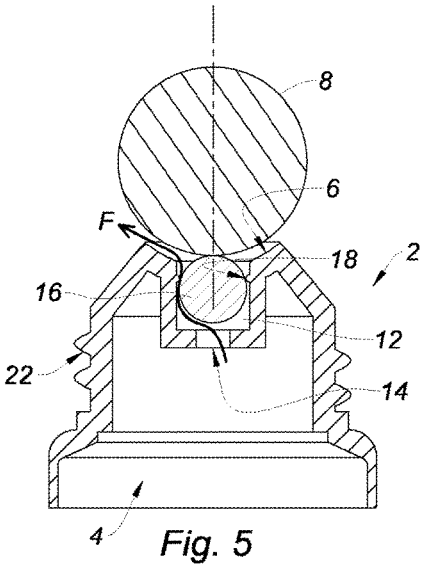

FIGS. 4 and 5 show a similar application head 2, the housing 6 of the application ball 8 including a completely spherical surface containing no circular boss, so that this ball can fit thereabove.

In the closed position shown in FIG. 4, the application ball 8 wedged by the cap 20, or applied on the skin of the patient with some pressure, presses the small magnetized ball 16 which moves back and closes the rear bore 14 of the transverse partition of the chamber 12.

It will be noted that in this position, there is a small axial clearance between the application ball 8 and the spherical surface of its housing 6, so as to obtain a pressure which is done on the magnetized ball 16 and not on this surface, in order to provide the closure of the rear bore 14 by this magnetized ball.

In the open position shown in FIG. 5, in the same manner a pressing of the care product in the lower volume 4 pushes the magnetized ball 16 which rises, raising also the application ball 8. An opening of the passage of this product indicated by the arrow F, the magnetized ball 16 holding by its attraction the application ball 8 in its housing 6, is obtained.

Figure 6:
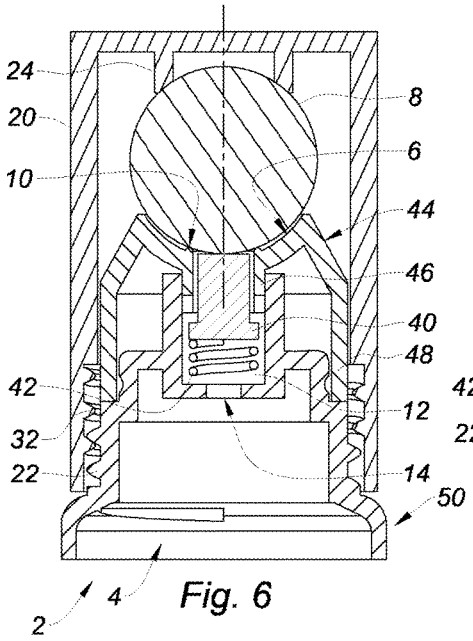
FIGS. 6 and 7 are axial sectional views of an application head according to another variant, shown successively in the closed position with a plug, and in the open position.
Figure 7:
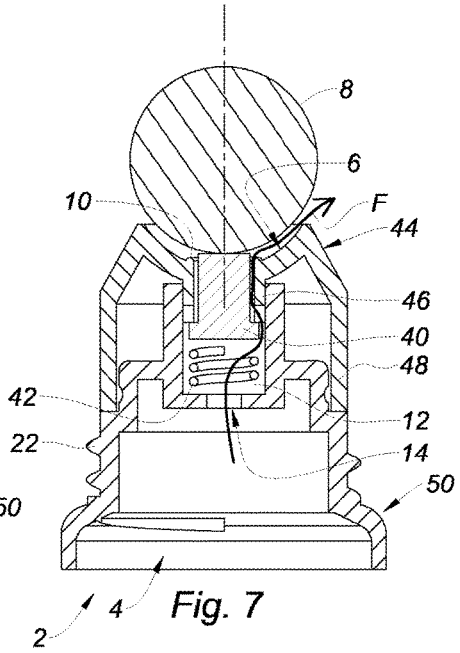

FIGS. 6 and 7 show an application head including a body 2 in two portions. A base 50 is covered by an upper portion 44 comprising the housing 6 of the application ball 8, having an outer cylindrical shape 48 facing downwards, fitting over a complementary shape of this base 50 in order to provide its positioning and its fastening.

The upper portion 44 also includes an inner cylindrical shape 46 facing downwards, fitting within the cylindrical chamber 12 of the base 50 of the body 2. A valve, formed in this embodiment by a cylindrical magnet 40 disposed in this chamber 12, fits within an axial bore of the inner cylindrical shape 46 so as to can slide therein.

Optionally, a coil spring 42 disposed in the chamber 12 bears on its lower partition in order to permanently press on the magnet 40 upwards, this magnet being retained in its upper position by a circular shoulder located at its base, bearing on the lower end of the inner cylindrical shape 46.

The spherical surface of the housing 6 includes the circular boss 10, such as for the first variant of application head. In the closed position shown in FIG. 6, the application ball 8 bears on the circular boss 10, the magnet 40 as well as its spring 42 being pushed back downwardly, which closes the passage of the care product.

In the open position shown in FIG. 7, the spring 42 pushes back the magnet 40 which raises the application ball 8 by opening the passage of the care product indicated by the arrow F, this ball remaining in its housing 6 thanks to the attraction of this magnet.

In a version without the spring 42, as for the preceding variants, the internal pressure of the care product may also raise the magnet 40 as well as the application ball 8.

This other variant of the body of the application head includes an additional part consisting of the upper portion 44. However, the upper face of the magnet 40 which is flat, has a surface closest to the application ball 8 which provide a better holding of this ball.

Figure 8:
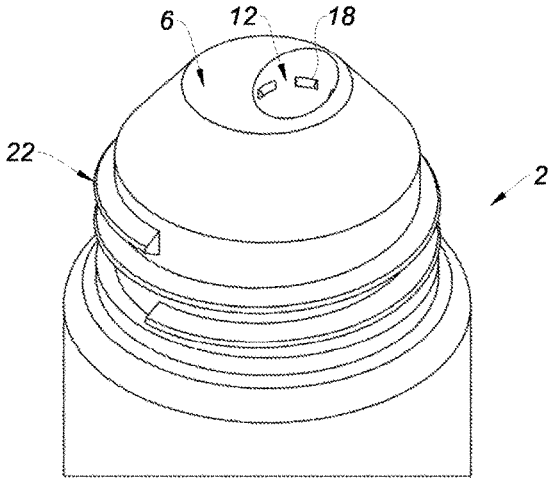
FIGS. 8 to 10 are views of an application head according to another variant, shown successively in perspective without the application ball, and in axial section with and without plug.
Figure 9:
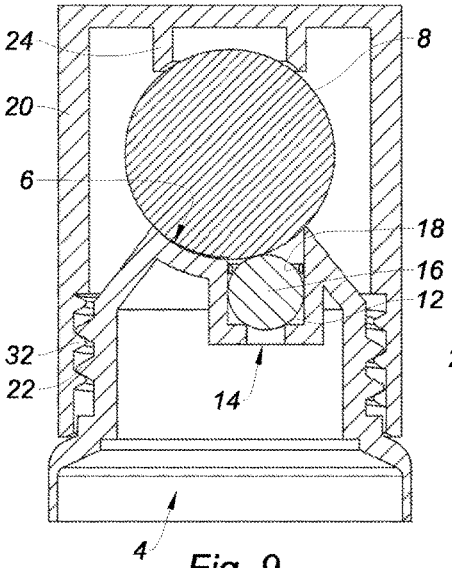
Figure 10:
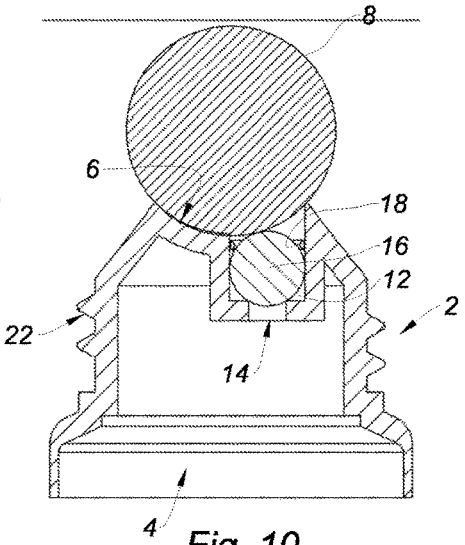

FIGS. 8 through 10 show an application head including a body 2 comprising a cylindrical chamber 12 laterally shifted relative to the main axis of this body. This chamber 12 therefore opens into the housing 6 of the application ball 8, in a shifted manner while remaining within this housing.

This solution can provide better stability of the application ball 8 at the time of care, as well as a better centering of this ball.

The application ball bears on the magnetized ball 16. It is the one which closes the passage of the product 14 at the bottom of the housing 12.

Figure 11:
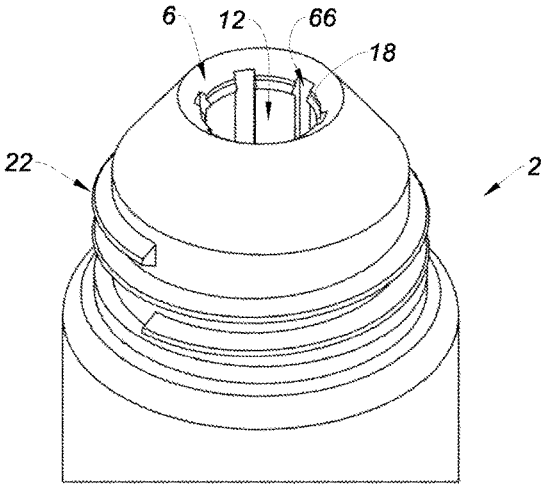
FIGS. 11 to 13 are views of an application head according to another variant, shown successively in perspective without the application ball, and in axial section with and without cap.
Figure 12:
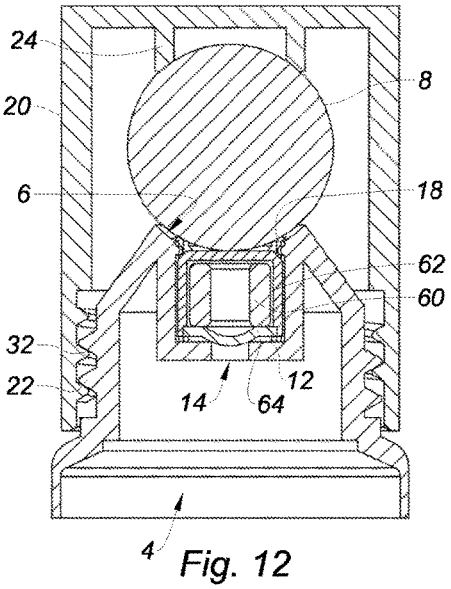
Figure 13:
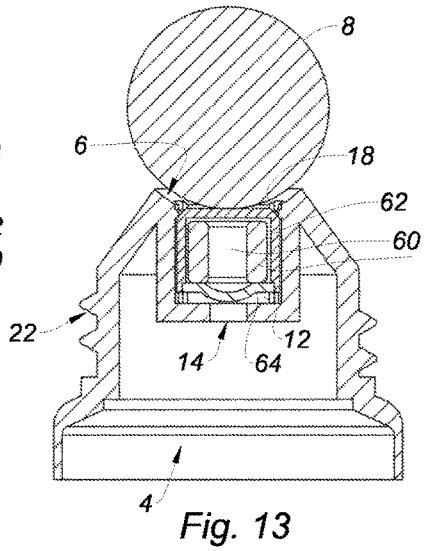

FIGS. 11 to 13 show an application head including a body 2 comprising a cylindrical chamber 12 which accommodates a cylindrical cartridge 62 forming valve fitted therein, having a cylindrical portion and an upper bottom, equipped with a bottom cover 64 closing this cartridge. The cover 64 has a central boss facing downwardly, fitting over the rear bore 14 in order to close it when the cartridge 62 is in its lower position.

The cartridge 62 contains a magnet 60 forming a ring which is fitted therein.

The cartridge 62 is held in the upper position by the inner relief 18 including vertical grooves allowing the care product to go along this cartridge to pass thereabove.

The cartridge 62 with its lower cover 64 constitutes a protection of the magnet which is therefore not in contact with the cosmetic product, which allows selecting ferritic steel magnets without surface treatment to protect it, which are more economical but corrosion sensitive.

Figure 14:
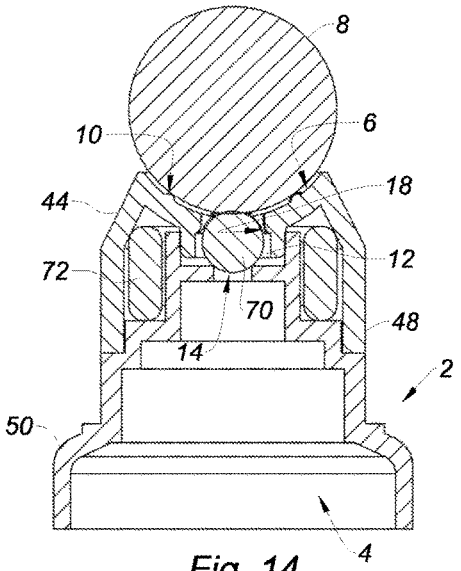
FIGS. 14 to 16 are views of an application head according to another variant, shown successively in axial section in the closed and open position, and in an exploded view.
Figure 15:
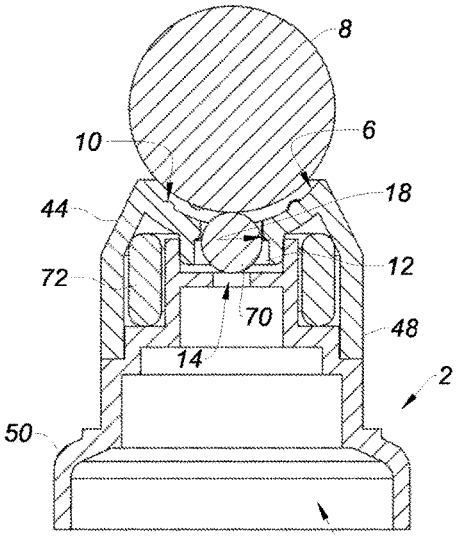
Figure 16:
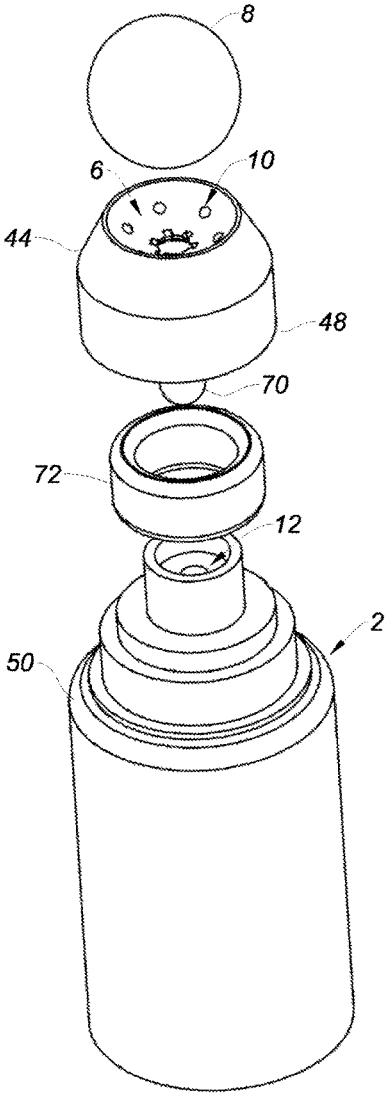

FIGS. 14 to 16 show an application head including a body 2 in two portions, having a base 50 covered by an upper portion 44 comprising the housing 6 of the application ball 8, having small projections 10 spaced apart. The upper portion 44 downwardly has a circular outer contour 48 fitting over a complementary shape of the base 50, in order to provide the positioning and the fastening.

The upper portion 44 also includes an inner circular shape 46 facing downwards, fitting into the chamber 12 of the base 50, having the interrupted circular inner relief 18, which holds a ball forming a valve 70 in this chamber.

An annular magnet 72 surrounding the chamber 12, is fixedly held in a housing disposed between the upper portion 44 and the base 50. This annular magnet 72 attracts the application ball 8 in order to hold it in its housing 6, the ball 70 having a valve function which closes the rear bore 14 when it is in the rear position, pushed by the cap.

The ball 70 made of a material which is not attracted by the magnet 72, can be plastic, glass, ceramic or non-magnetic steel.

Thus, there is a magnet 72 with significant size which can develop a high force of attraction on the application ball 8, while being out of the passage of the care product which avoids providing a material or a protective treatment against the activated corrosion in contact with the care product. It is possible to make this magnet in an economical manner.

FIG. 16 shows the assembly of the components of this application head which is easily done by stacking the different parts, the upper portion 44 fastened to the base 50 holding them in position.

It has been mentioned, as a main application, a care or a treatment of the skin. This device can also be used to apply any liquid product on any surface. It is possible, for example, to use it to apply a makeup product for eyes, lips, nails or the skin, slimming product, deodorant, washing agent, antiwrinkles or concealers, a household product, cleanser, washing agent, a soap, a liquid glue, a painting, an ink, without this list being exhaustive.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An application head of a product, including a body substantially of revolution having at its front axial end a hollow spherical surface forming a housing fittingly accommodating a magnetizable application ball held by a magnet, the body being provided to accommodate therein the product, wherein the body includes a chamber located along a passage of the product coming from an inside of the body in order to open into the housing, the chamber containing a valve, the valve being one of the magnet or a non-magnetized body held within the chamber, the valve sliding along an axial stroke by remaining adhered to the application ball, in order to perform, in a rear position, a closing of the passage, and in a front position, an opening of this passage.

2. The application head according to claim 1, wherein the chamber includes a substantially cylindrical shape having an axis parallel to an axis of the body.

3. The application head according to claim 1, wherein the chamber is laterally shifted relative to an axis of the body.

4. The application head according to claim 1, wherein the valve is held forwards within the chamber, by an inner relief of the chamber allowing passage of the product.

5. The application head according to claim 1, wherein the valve is held forwards within the chamber by an upper portion of the body fastened on a base of the body.

6. The application head according to claim 1, wherein the valve is the magnet and is a magnetized ball.

7. The application head according to claim 1, wherein the valve closes the passage by bearing, in its rear position, on a bore of a rear wall of the chamber that constitutes the passage of fluid product.

8. The application head according to claim 1, wherein the valve is the magnet and is a magnetized cylindrical body having an outer shoulder which forms a front stop allowing passage of the product.

9. The application head according claim 1, wherein said application ball closes the passage by bearing, in its rear position, on a boss of a surface of the housing, which surrounds the passage of the product opening into the housing.

10. The application head according to claim 1 further comprising a spring that permanently presses the valve forwards.

11. The application head according to claim 1 further comprising a cap comprising therein shapes that hold the application ball pressed in the housing.

12. The application head according to claim 1, wherein said application ball is a stainless steel material.

13. The application head according to claim 1, wherein said application ball comprises an anti-oxidation surface treatment.

14. The application head according to claim 1, wherein said application ball is hollow.

15. The application head according to claim 1, wherein the magnet is enclosed in a sealed protective casing.

16. The application head according to claim 1, wherein the magnet is fixed.

17. An applicator having a reserve of cosmetic product, and an application head provided to perform massages of the skin, wherein head is made according to claim 1.

* * * * *